United States Patent [19]

Luther et al.

[11] Patent Number: 4,920,888

[45] **Date of Patent: * May 1, 1990**

[54] SUBCALIBER, FINSTABILIZED PENETRATOR PROJECTILE

[75] Inventors: Hans W. Luther; Juergen Winkelmann, both of Kaarst, Fed. Rep. of Germany; Jean-Claude Sauvestre, St Doulchard; Patrick Montier, Bourges, both of France

[73] Assignees: Rheinmetall GmbH, Dusseldorf, Fed. Rep. of Germany; Etat Francais, Armees, France

[ * ] Notice: The portion of the term of this patent subsequent to Jan. 13, 2004 has been disclaimed.

[21] Appl. No.: 142,044

[22] Filed: Jan. 7, 1988

Related U.S. Application Data

[63] Continuation-in-part of Ser. No. 759,059, Jul. 24, 1985, abandoned, which is a continuation-in-part of Ser. No. 476,409, Mar. 17, 1983, abandoned.

[30] Foreign Application Priority Data

Mar. 17, 1982 [DE] Fed. Rep. of Germany ..... 3209594

[51] Int. Cl.[5] ..... F42B 11/06

[52] U.S. Cl. ..... 102/518

[58] Field of Search ..... 102/514–519, 102/321

[56] References Cited

U.S. PATENT DOCUMENTS

| | | | |
|---|---|---|---|
| 3,213,792 | 10/1965 | Grenander et al. | 102/519 |
| 3,370,535 | 2/1968 | Permutter | 102/518 |
| 4,108,072 | 8/1978 | Trinks et al. | 102/518 |
| 4,108,073 | 8/1978 | Davis | 102/518 |
| 4,353,302 | 10/1982 | Strandli et al. | 102/518 |
| 4,353,305 | 10/1982 | Moreau | 102/518 |
| 4,635,556 | 1/1987 | Baecker et al. | 102/518 |
| 4,708,064 | 11/1987 | Bisping et al. | 102/517 |
| 4,716,834 | 1/1988 | Wallow et al. | 102/519 |

*Primary Examiner*—Harold J. Tudor
*Attorney, Agent, or Firm*—Klein & Vibber

[57] ABSTRACT

A penetrator shell has at least a front and a rear high-density core element each having a front face and a rear and lying in a stack extending along an axis with the front face of the rear element engaging the rear face of the front element. The rear face of the front element and front face of the rear element are substantially complementary, part-spherical, and centered on the axis. Thus, the front element can rock or pivot on the rear element while remaining in contact with the front face thereof. A high-density main penetrator body is engaged against and extends axially rearward away from the rear face of the rear element. A casing sleeve is engaged snugly around the core elements and has a front end generally at the front element and a rear end secured to the main penetrator body. An aerodynamic tip is secured to and extends axially forward from the front end of the sleeve.

7 Claims, 2 Drawing Sheets

SUBCALIBER, FINSTABILIZED PENETRATOR PROJECTILE

CROSS-REFERENCE TO RELATED APPLICATIONS

This is a continuation-in-part application of our co-pending application Ser. No. 759,059, filed July 24, 1985, now abandoned which is a continuation-in-part of Ser. No. 476,409, filed Mar. 17, 1983 and now abandoned.

This application is also related to our co-assigned and allowed application Ser. No. 412,794, filed Aug. 23, 1982 now U.S. Pat. No. 4,708,064 and Ser. No. 476,408, filed Mar. 17, 1983, now U.S. Pat. No. 4,635,556.

FIELD OF THE INVENTION

The present invention relates to an armor-piercing projectile. More particularly this invention concerns a penetrator shell having a front end formed of a stack of high-density core elements.

BACKGROUND OF THE INVENTION

The projectiles disclosed in the afore-mentioned applications generally include a plurality of pre-penetrator elements mounted in a casing one behind the other. The pre-penetrator elements of this projectile consist of hard metal or metal of high density and the projectile also includes a main penetrator body which is axially disposed behind the penetrator elements and contiguous thereto. This main penetrator body also is generally made of a metal of high density. By providing a plurality of pre-penetrator elements of different sizes or materials, a desired decrease in mass of the projectile arrangement is thereby realized so that, after penetration of an exterior armor, there remains sufficient projectile mass in the form of the main penetrator body for the penetration (i.e. destruction) of the main armor plating disposed behind the exterior armor.

Projectiles of the afore-described type are, at penetration of a plurality of target plates in a direction transversely to the longitudinal axis of the projectile, exposed to certain effective loads, which may lead to a premature bending failure (breaking) of the projectile. If the penetration channel is inclined with respect to the direct linear extension of the projectile flight path, the main penetrator body can, after impacting on the main armor, negatively affect the latter and thereby the effectiveness of the projectile in a very sensitive manner.

In accordance with the allowed and co-assigned U.S. application Ser. No. 412,794, the desired successive reduction of the pre-penetrator cores at penetration of the target is achieved in that the configuration of the abutting pre-penetrator elements and the mating surrounding casing are designed in such a way that at the inclined impact of the projectile on the target certain transverse forces act on the pre-penetrator elements with adaptation for different targets so as to lead to a controlled pre-penetrator reduction. Such a tolerating of the dimensioning has proven to be quite cumbersome. In view of the fact that the casing surrounding the pre-penetrator elements must in the known arrangements have the same wall thickness from front to back, the danger exists that it, as a result of the laterally acting forces, breaks prematurely at rearwardly located loci and thereby the desired effect of the successive breaking of the individual pre-penetrator elements is not achieved.

According to application Ser. No. 476,408 the successive braking of the pre-penetrator cores is achieved by shaping the individual cores in such a way that in the abutting surface region they connect as pivotal joints and that fracture zones in the outer casing are present adjacent to these pivotal joints. Such a construction of a projectile is quite complex, since the front and rear surfaces of the cores must have from front to back increasing inclinations with respect to the longitudinal axis of the projectile for the purpose of achieving the desired breaking up. This makes an exchange of the cores between each other for adaptation to different target characteristics of the target plates impossible.

A standard armor-piercing penetrator shell, as described in U.S. Pat. No. 4,108,072 of Trinks has a front end constituted by a stack of high-density core elements held in a containment sleeve. This stack is secured to the front end of high-density main penetrator body. Shock-absorbing layers of resin-bound hollow microspheres are provided between the core elements. The front end of the core-element stack is provided with a normally hollow tip mainlY serving aerodynamic purposes.

When such a projectile strikes a target, for instance of laminated or cellular armor, the core elements operate the original hole. The shock-absorbing layers between the elements prevents the impact shock from being transmitted back to the main penetrator body, so the same remains intact and can transfer its mass and energy to the underlying armor layer.

Thus, this patent discloses a penetrator projectile in which the individual cores are not in abutting direct contact with each other, but are separated from each other by means of dampening elements. Therefore, the Trinks projectile loses at impact on the target the optimum guidance and centering between the individual cores as a result of the "spreading out" of the casing so that a controllable decomposition of the projectile body is not possible in the Trinks projectile, because such body is already decomposed at impact on the first (outer) target plate. In contradistinction thereto, in the projectile of the invention as defined in the claims, at penetration of the first target plate, the first pre-penetrator core decomposes up to the pre-selected fracture or separation region and is separated from the remaining projectile bodies so that for the next second target plate the next following second pre-penetrator core with its cutting edge is available. Thus, each one of the target plates consumes only the corresponding frontally disposed pre-penetrator cores, which means that the result of the material properties of the material making up the pre-penetrator core it disintegrates due to its fragility into sufficient small pieces so that it does not represent an obstacle for the next following main penetrator.

With all of the afore-described embodiments the casing has the same closed section in the region of each fracture zone of the projectile. This brings about the danger, that the projectile breaks up prematurely in a more rearwardly disposed region and thereby makes impossible the desired successive breaking up from front to back. Moreover, the known "stacked projectiles" have three or more pre-penetrators; they are therefore not adaptable for acting against a modern armor which generally has three armored plates disposed one behind the other at predetermined distance from each other and which target plates have generally different thicknesses.

OBJECT OF THE INVENTION

It is therefore an object of this invention to provide a projectile having a stack of cores in such a way so as to optimize that, when it impacts obliquely on an armored target consisting of three plates rather than predetermined distance from each other. It can nevertheless be maintained safely in its firing direction. Moreover, the projectile having stacked cores is easily adaptable to different target plate constructions. This object is achieved, in contradistinction to the arrangement of U.S. Pat. No. 4,635,556 by means of the following measures:

1. there are only two pre-penetrators present made of brittle materials;
2. the casing is of unitary construction relative to the ballistic hood and consists of aluminum;
3. the casing is exchangeably mounted at its rear end via a connecting portion having a smaller diameter than the main core;
4. the casing maintains the cores in opposite position bY way of mutually engaging play free seats;
5. the main core and at least the second pre-penetrator core which follows the first pre-penetrator core have on their frontal surfaces cutting edges which are normal to the longitudinal axis of the projectile;
6. the degree of convexity, respectively concavity of the abutting surfaces of the pre-penetrator cores which act like pivot joints in the region of the fracture zones is in all regions identical;
7. the casing has in the region of the first fracture zone between both pre-penetrators a weakened wall portion (groove) so that the casing and the first core break off, as soon as the latter impacts on the first target plate when the impact is influenced by lateral forces;
8. the wall thickness and the material properties of the casing are selected in such a way that the casing in the region of the second fracture zone breaks up as soon as the second pre-penetrator penetrates into the middle target plate of a triple-plate on that target; and
9. the casing, made out of aluminum, a light metal, is of such a strength that the pre-penetrator core is centered on the main penetrator core in the target direction until its penetration into the corresponding target plate.

In this way, the main penetrator core can penetrate without obstacles into the third target plate. Depending on the built-up of the target plates there can thereby by means of a simple unthreading of the casing from the main penetrator core be achieved an adaptation of the projectile to different target plate constructions.

In order to avoid a softening of the casing during the demands made thereon during the flight, the ballistic hood can be armed with a steel body which has at its front a hemisphere point. The forward surface of the first pre-penetrator core can also be spherically shaped, but can also be formed by two stepped surfaces which are normal to the projectile axis, so that they act like two cutting surfaces. The pivot-like joints of the cores can be achieved in that the abutting surfaces of the cores are shaped one as a hemispheric surface and the other as a hollow spherical callotte.

In the region of the forward end of the main core the pivot-like point can also be made sufficient when the forward end of the main core is formed as a conical surface and the rearward end of the thereagainst abutting pre-penetrator is conically formed or shaped.

SUMMARY OF THE INVENTION

The projectile of the invention is constructed as follows:

a penetrator shell has two front cores and a rear high-density core element, each having a front face and a rear face and lying in a stack extending along an axis with the front face of the rear element engaging the rear face of the front element. The rear face of the front element and front face of the rear element are substantially complementary, part-spherical, and centered on the axis. Thus, the front element can rock or pivot on the rear element while remaining in contact with the front face thereof. A high-density main penetrator body is engaged against and extends axially rearward away from the rear face of the rear element. A casing sleeve is engaged snugly around the core elements and has a front end generally at the front element and a rear end secured to the main penetrator body. An aerodynamic tip extends axially forward from the front end of the sleeve.

As a result of the articulated connection between adjacent ends of the core elements a premature breaking-up of the projectile is largely avoided. In addition a given projectile can be constructed to be particularly effective against a specific type of armor.

According to a feature of this invention the main penetrator body has a part-spherical front face centered on the axis and substantially complementary to the rear face of the rear element. Thus, the rear element can pivot on the main body while remaining in contact with the front face thereof.

To prevent excessive shock transmission from the core elements to one another or to the main penetrator body, at least one of the core elements has a relatively soft portion forming one of the respective faces. This soft portion is formed of a light metal, a light-metal alloy, a synthetic resin, or a combination of all three materials. In addition the main penetrator body can, according to this invention, have a front face formed as such a soft portion and engaging the rear face of the rear element. The mass ratio of the front element to the rear element to the main penetrator body is generally 1:1.2:6.

The sleeve is removably attached to the main body, normally by means of a screwthread.

BRIEF DESCRIPTION OF THE DRAWING

The above and other features and advantages will become more readily apparent from the following, reference being made to the accompanying drawing in which.

SPECIFIC DESCRIPTION

Figure 1:
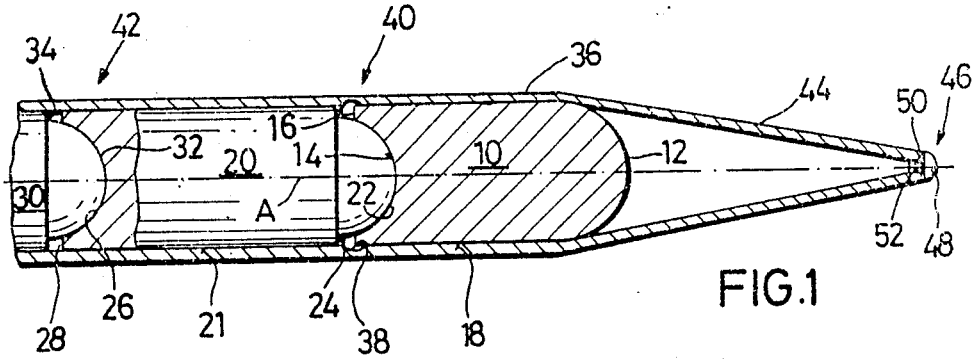
FIGS. 1 through 5 are axial sections through the front portions of five different penetrator shells according to this invention.

As seen in FIG. 1 a penetrator shell has a front core element 10, a rear core element 20 and a main penetrator body 30 all centered on an axis A. The front element 10 has a semispherical front face 12 centered on the axis A and a cylindrical outer surface 18. Its rear end is formed by an annular and planar surface 16 lying in a plane perpendicular to the axis A, and a part-spherical recess 14 also centered on the axis A.

The rear element 20 has a part-spherical front face 22 centered on the axis A and complementary to the surface 14. This surface 14 goes over into a planar annular surface 24 like the surface 16 but spaced axially therefrom. The element 20 has cylindrical side surface 21 terminating at a surface 28 like the surfaces 16 and 24 and bounding a rearwardly concave part-spherical surface or recess 26 identical to the surface 14.

The penetrator body 30 in turn has a part-spherical front face 32 centered on the axis A and complementary to the surface 26 and a planar annular rim 34 confronting and spaced from the rim 28.

It is therefore possible for the front element 10 to rock on the rear element 20 with the surfaces 14 and 22 remaining in surface contact, and similarly for the rear element 20 to rock on the main body 30 with the surfaces 26 and 32 also remaining in surface contact. This allows the shell to turn into any surface it impacts rather than just being broken apart by a flat contact.

The elements 10 and 20 and the front end of the body 30 are surrounded by a casing sleeve 36 of cylindrical shape snugly engaging the surfaces 18 and 21 and having a front end formed as a conical aerodynamic tip 44 centered on the axis A. The extreme front end of this tip 44 is formed at the axis A with a small-diameter bore 52 into which fits a stem 50 of a mushroom-shaped steel point 46 having a head 48 lying against the front tip end.

The sleeve 36 is formed at a region 40 level with the joint between the elements 10 and 20 with a radially inwardly open groove 38. This groove 38 causes on impact a preset break transversely relative to the longitudinal axis of the projectile. Another such break zone could be provided at 42 at the joint between the rear element 20 and the main body 30.

Figure 2:
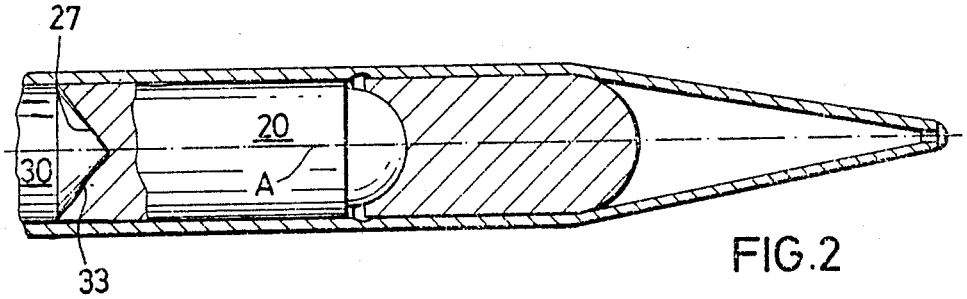

FIG. 2 shows a system identical to that of FIG. 1 except that the body 30 has a conical front end 33 that fits into a complementary conical recess 27 at the rear face of the rear element 20.

Figure 3:
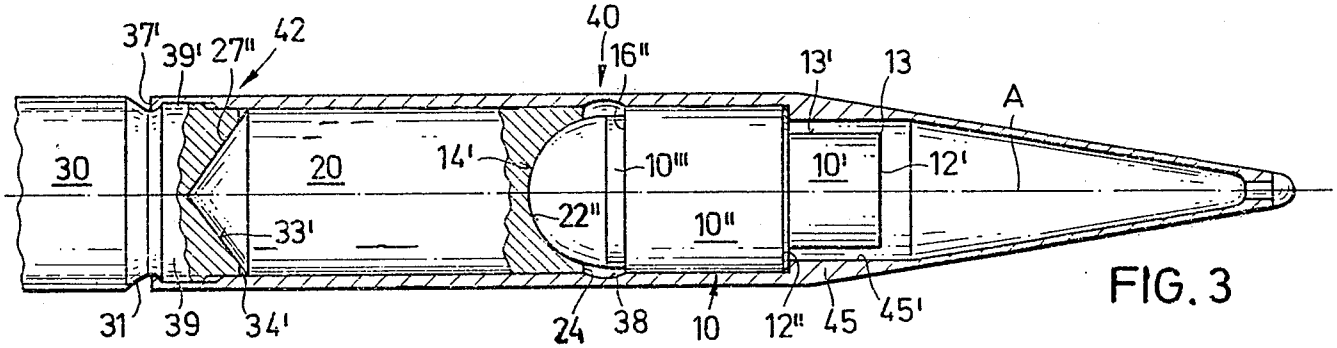

In FIG. 3 the front element 10 has a front portion 10' of cylindrical shape extending from a main portion 10'' also of cylindrical shape. The front portion 10' has a planar front face 12' joining a cylindrical side surface 13' at a circular edge 13 and this side surface 13' is connected via a planar annular surface 12'' perpendicular to the axis A to the outer surface 18 of the portion 10''. The main portion 10'' has a planar and annular rear end face 16'' from which projects a short cylindrical region 10''' which in turn goes over into a part-spherical surface 14' received in a part-spherical recess 22'' formed at the front end of the rear element 20.

At its rear end the rear element 20 has a conical rear face 27'' engaging in a complementary recess 33' of the main body 30. A narrow annular and planar surface 34' extends between the outer edge of the recess 33' and the outer surface of the main body 30.

A front portion 39 of the main body 30 is formed with a screwthread to which is connected the rear end 37' of the sleeve 44. A groove 31 is formed immediately behind the screwthread 39' in the main body 30. Level with the front part 10' the sleeve 44 is formed with a thickened region 45 having a cylindrical inner surface 45' spaced out from the surface 13'.

With this system it is possible to remove the entire front portion and change this portion or one or both of the elements 10 and 20 relatively easily right in the field, to tailor the projectile to a particular type of target. The detachable connection of the casing with the main core is provided for in all embodiments, but is only illustrated in FIG. 3.

Figure 4:
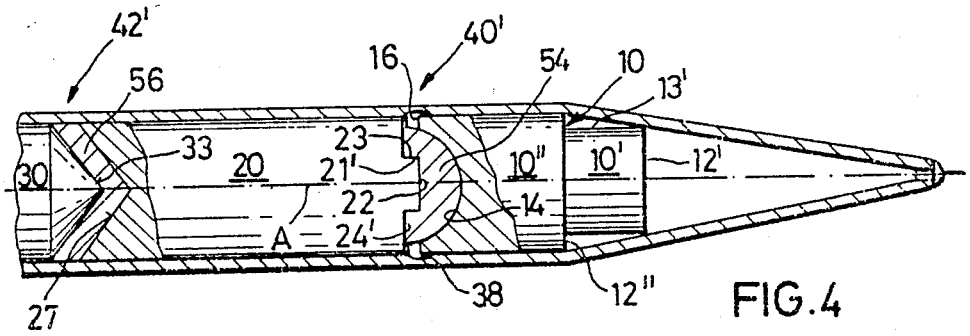

The arrangement of FIG. 4 has a front element 10 substantially identical to the element of FIG. 3, except that it is formed at its rear face exactly like the element 20 of FIG. 1. The rear body 20 is of substantially the same Shape as the body 20 of FIG. 2. It is however provided with a shock-absorbing element 54 forming the front surface 22. This element is mounted on a cylindrical peg or projection 23 projecting forwardly from a surface 24' forming the surface 24 and the element 54 has a recess 21' into which this peg fits complementarily.

In addition between the surfaces 27 and 33 there is provided a layer 56 of the same shock-absorbing material that the body 54 is made of, either a light metal such as aluminum or a synthetic resin. Otherwise this embodiment is identical to that of FIG. 1.

Figure 5:
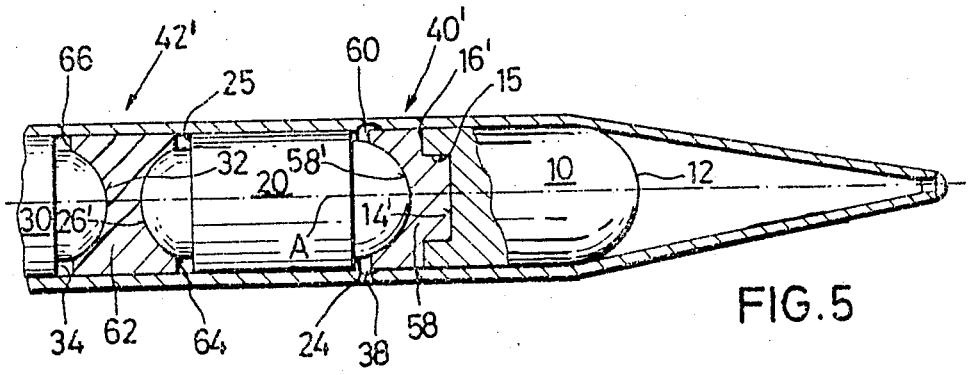
Figure 6:
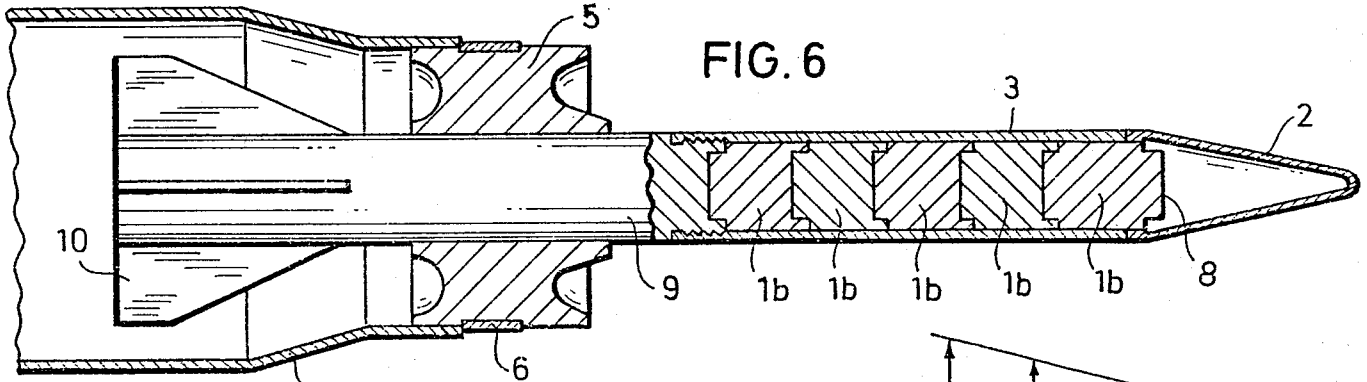
FIG. 6 is a side elevational view of a fin-stabilized subcaliber projectile of large length to diameter ratio in accordance with our coassigned allowed U.S. patent application Ser. No. 412,794 now U.S. Pat. No. 4,708,064.
Figure 7:
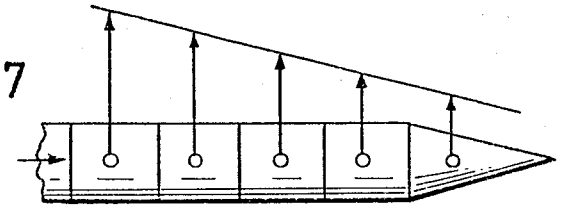
FIG. 7 illustrates schematically the increase of the lateral forces of penetration of target which act on a penetrator projectile.

In FIG. 5 the front and rear elements 10 and 20 have the same external shape as in FIG. 1. The front element 10 has a rear end formed of a soft insert 58 defining a part-spherical recess 58' functionally identical to the surface 14 of FIG. 1. This insert 58 has a front face 16' from which projects a cylindrical centering peg 15 received in a cylindrical axially centered recess 14' of the front part of the body 10. A planar and annular rim 60 functionally identical to the rim 16 of FIG. 1 is formed by this insert 58 at the break zone 40 level with the break groove 38.

In addition the rear element 20 engages via a shock-absorbing element 62 against the front face 32 of the element 30. This element 62 has a front face formed with a part-spherical recess 26' receiving a complementary projection on the element 20 and bounded by an annular rim 64 facing an identical such rim 25 on the element 20. Thus, this element 62 forms a rear break zone 42'.

In all of the above-described embodiments the ratio of the mass of the front element to that of the rear element to that of the main penetrator body is about 1:1.2:6. The body 30 is formed of a very strong and ductile heavy-metal alloy, for example, a sintered tungsten alloy having a high tungsten content. The elements 10 and 20 are made of a similar material but of lesser ductility. When a shock absorber 58 is used in the front element 10 can also be ductile like the body 30. The high-strength ductile heavy-metal alloys for the front element 10 and the main body 30 have an elasticity between 10% to 45% and have preferably a minimum tensile strength of 900 $n/mm^2$–1500 $n/mm^2$ and a density of 16 $grams/cm^3$ and 18 $grams/cm^3$. A typical high-strength heavy metal alloy having good malleability characteristics are sintered alloys having a high tungsten content such as described in U.S. Pat. No. 3,979,234. However heavy metal alloys consisting of depleted uranium are also suitable.

The more ductile heavy metal alloys forming the element 20 can, for example, be a heavy metal alloy, having a tungsten content and a reduced ductility which have, in contradistinction thereto, an elasticity between 0% and 10%, a tensile strength from 1500 n/cm$^3$ to 19.1 gram/cm$^3$.

The shock absorber 58 can be made of light metal and/or a light metal alloy (for example, an aluminum alloy) and/or synthetic material.

When the projectile according to this invention hits an armored target its front part will be able to flex and bend at the regions 40 and 42. The ductile casing sleeve will absorb any transverse forces by deforming and will ensure excellent force transmission to the core elements. When such a projectile enters a void in the armor, as are newly provided to increase armor effectiveness, the shell will not disintegrate but will penetrate further.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. An improved subcaliber fin-stabilizer penetrator projectile which has a ballistic hood coaxially mounted on the front end thereof and a plurality of pre-penetrator cores consisting essentially of tungsten alloy and mounted one behind the other in an axial direction behind said ballistic hood, and a main penetrator body consisting essentially of tungsten alloy, a cylindrical casing having a smooth external surface being operatively detachably connected with said main penetrator body, said plurality of pre-penetrator cores being operatively mounted partially in said cylindrical casing and partially in said ballistic hood, the improvement comprising in combination (a) said cylindrical casing axially extends rearwardly from the ballistic hood to a forward region of the main penetrator;

(b) the outer diameter of the main penetrator corresponds to the outer diameter of the cylindrical casing so that the projectile presents a substantially smooth outer cylindrical surface over its entire axial length with the exception of the ballistic hood;

(c) each one of the plurality of pre-penetrator cores has the same external diameter and said plurality of pre-penetrator cores are of complementary shape so that the front surface of the rearmost core abuts against the rear mating surface of the next forwardly positioned pre-penetrator core and so on;

(d) the mutually contacting front and rear surfaces of the respective pre-penetrator cores are matingly shaped;

(e) the confronting surfaces of the adjoining pre-penetrator cores are complementarily axially convexly and concavely shaped;

(f) each pair of confronting surfaces of adjoining cores and said casing jointly define an annular space in said casing;

(g) the rear end surface of each pre-penetrator core and the front surface of the corresponding pre-penetrator core being rounded off and matingly shaped so that when the foremost pre-penetrator core pivots with respect to the next rearwardly adjoining pre-penetrator core the next rearwardly adjoining pre-penetrator core maintains its direction of movement;

(h) there are only two pre-penetrator cores present, a front pre-penetrator core followed by a rear pre-penetrator core, both made of brittle materials;

(i) the casing is of unitary construction relative to the ballistic hood and consists essentially of aluminum;

(j) the casing is exchangeably mounted at its rear end, said penetrator body has a front end portion which has a smaller diameter than the remainder of said penetrator body, said casing being mounted on said front end portion;

(k) the casing maintains the pre-penetrator cores in confronting position by way of mutually engaging play free seats;

(l) the main penetrator body and at least the rear pre-penetrator core which follows the front pre-penetrator core have on their frontal surfaces cutting edges which are normal to the longitudinal axis of the projectile and respective first and second fracture zones are formed in said casing in confronting relationship to said cutting edges;

(m) the degree of convexity, respectively concavity of the abutting surfaces of the pre-penetrator cores which act like pivot joints in the region of the fracture zones is in all regions identical;

(n) the casing has in the region of the first fracture zone between both pre-penetrators a weakened wall portion so that the casing and the first pre-penetrator core break off, as soon as the latter impacts on the first target plate when the impact is influenced by lateral forces;

(o) the wall thickness and the material properties of the casing are selected in such a way that the casing in the region of the second fracture zone breaks up as soon as the second pre-penetrator penetrates into the middle target plate of a triple plate on that target; and (p) the casing is of such a strength that each pre-penetrator core centers on the main penetrator body in the target direction until its penetration into the corresponding target plate.

2. The improved subcaliber penetrator projectile defined in claim 1, wherein said penetrator projectile includes the front and the rear pre-penetrator, the mass ratio of the front pre-penetrator to the rear pre-penetrator to the main penetrator body is generally 1:1.2:6.

3. The improved subcaliber penetrator projectile as set forth in claim 1, wherein said ballistic hood is made out of light metal alloy and has a forward-most mushroom-shaped steel point.

4. An improved subcaliber fin-stabilized penetrator projectile for combating multi-armor plated targets having a projectile body of uniform cylindrical shape over substantially its entire axial length, the improvement comprising in combination:

a main penetrator element;

a front and a rear preselected armor-piercing pre-penetrator element said pre-penetrator elements being coaxially operatively mounted in front of said main penetrator element;

a cylindrical casing of uniform wall thickness having a substantially smooth exterior wall surface encompassing said pre-penetrator elements and a forward portion of said main penetrator element, said cylindrical casing being mounted on the forward portion of said main penetrator via detachable connecting means;

a ballistic hood unitary with the cylindrical casing, both the hood and the cylindrical casing being made of light metal;

the exterior diameter of the main penetrator element behind said detachable connecting means being equal to the exterior diameter of the cylindrical casing so as to prevent a continuous uniform cylindrical surface;

the respective regions of adjoining pre-penetrator elements which adjoin each other being respectively convexly and concavely matingly shaped, said matingly shaped adjoining regions providing a pivoting movement of adjoining pre-penetrator elements upon target impact:

said projectile having two fracture zones a first one of which is disposed between said pre-penetrator elements and a second one of which is disposed between the rear pre-penetrator element and the main penetrator element and said casing having a weakened wall at said first fracture zone, the casing and the pre-penetrator elements being exchangeable, whereby the materials of said pre-penetrator elements and said casing can be preselected in accordance with the target prior to use by detaching said casing from said main penetrator element and mounting preselected pre-penetrator elements in said casing prior to assembly.

5. The improved subcaliber penetrator projectile as set forth in claim 4, including a shock absorbing dampening element disposed between adjoining pre-penetrator elements and between the rear pre-penetrator element and the main penetrator element said shock absorbing dampening element consisting of a material selected from the group of materials of light metal, light metal alloy and synthetic material, said dampening element having an axial length which is less than the axial length of any one of the pre-penetrator elements.

6. The improved subcaliber penetrator projectile defined in claim 4, wherein the mass ratio of the front pre-penetrator element to the rear pre-penetrator element to the main penetrator element is generally 1:1.2:6.

7. The improved subcaliber penetrator projectile as set forth in claim 4, wherein said ballistic hood is made out of light metal alloy and has a forward-most mushroom-shaped steel point.

* * * * *